US009305721B2

(12) United States Patent
Izawa et al.

(10) Patent No.: US 9,305,721 B2
(45) Date of Patent: Apr. 5, 2016

(54) SWITCH AND KEYBOARD PROVIDED THEREWITH

(71) Applicant: OMRON Corporation, Kyoto-Shi (JP)

(72) Inventors: Kazuhira Izawa, Okayama (JP); Mamiko Naka, Okayama (JP)

(73) Assignee: OMRON CORPORATION, Kyoto-shi (JP)

( * ) Notice: Subject to any disclaimer, the term of this patent is extended or adjusted under 35 U.S.C. 154(b) by 0 days.

(21) Appl. No.: 14/337,687

(22) Filed: Jul. 22, 2014

(65) Prior Publication Data

US 2015/0041298 A1 Feb. 12, 2015

(30) Foreign Application Priority Data

Aug. 9, 2013 (JP) ..... 2013-166948

(51) Int. Cl.

| | |
|---|---|
| ***H01H 9/26*** | (2006.01) |
| ***H01H 13/26*** | (2006.01) |
| ***H01H 13/20*** | (2006.01) |
| ***H01H 13/02*** | (2006.01) |
| ***H01H 13/04*** | (2006.01) |
| ***H01H 13/70*** | (2006.01) |
| *H01H 9/02* | (2006.01) |

(52) U.S. Cl.

CPC ..... *H01H 13/26* (2013.01); *H01H 13/023* (2013.01); *H01H 13/04* (2013.01); *H01H 13/20* (2013.01); *H01H 13/70* (2013.01); *H01H 2009/0278* (2013.01); *H01H 2203/002* (2013.01); *H01H 2215/03* (2013.01); *H01H 2223/042* (2013.01); *H01H 2235/01* (2013.01)

(58) Field of Classification Search

CPC ..... H01H 13/26; H01H 13/03; H01H 13/04; H01H 13/70

USPC ..... 200/5 A, 341

See application file for complete search history.

(56) References Cited

U.S. PATENT DOCUMENTS

| | | | | | |
|---|---|---|---|---|---|
| RE30,435 | E | * | 11/1980 | Fukao | 200/345 |
| 5,144,103 | A | * | 9/1992 | Suwa | 200/344 |
| 5,199,556 | A | * | 4/1993 | Lee | 200/345 |
| 5,247,143 | A | * | 9/1993 | Suwa | 200/517 |
| 5,907,612 | A | * | 5/1999 | Aggus et al. | 379/368 |
| 5,973,284 | A | * | 10/1999 | Takenaka et al. | 200/532 |

(Continued)

FOREIGN PATENT DOCUMENTS

| | | |
|---|---|---|
| EP | 0 453 274 A2 | 10/1991 |
| JP | 03-208217 A | 9/1991 |

(Continued)

OTHER PUBLICATIONS

Extended European Search Report for Application No. 14177666.6 issued Jan. 8, 2015 (6 pages).

*Primary Examiner* — Kyung Lee

(74) *Attorney, Agent, or Firm* — Nutter McClennen & Fish LLP; John J. Penny, Jr.

(57) ABSTRACT

A switch comprising: a cover; a base; and a push button comprising: an elastic touch piece formed in a sidewall of a sliding part of the push button, wherein the push button is vertically and slidably installed in a space formed by assembling the cover to the base, wherein a free end of the elastic touch piece is configured to abut the base when the push button is pushed, and the free end is configured to abut the cover when the pushed push button is returned.

8 Claims, 13 Drawing Sheets

(56) References Cited

U.S. PATENT DOCUMENTS

| | | | | |
|---|---|---|---|---|
| 6,204,462 | B1 * | 3/2001 | Huang | 200/345 |
| 6,672,781 | B1 | 1/2004 | Takeda et al. | |
| 7,812,271 | B2 * | 10/2010 | Lee et al. | 200/5 R |

FOREIGN PATENT DOCUMENTS

| | | | |
|---|---|---|---|
| JP | 3887057 | B2 | 2/2007 |
| KR | 1993-0001367 | Y1 | 3/1993 |

* cited by examiner

SWITCH AND KEYBOARD PROVIDED THEREWITH

CROSS-REFERENCE TO RELATED APPLICATION

This application claims the benefit of priority from Japanese Patent Application No. 2013-166948, filed on 9 Aug. 2013, the entire contents of which is incorporated herein by reference for all purposes.

FIELD

The present invention relates to a switch, particularly to a silent type switch.

BACKGROUND

Conventionally, for example, Japanese Patent No. 3887057 discloses a push button switch including an operation knob in an upper portion and a covered square tubular main body in a lower portion. In one pair of side surfaces opposite to each other in the main body, an upper one is integrally provided with a pair of first spring bodies that is able to abut on a panel cover, and a lower one is integrally provided with a pair of second spring bodies that is able to abut on a member covered with the panel cover. In the push button switch, the first and second spring bodies are provided on the same outer surfaces of the main body and extended along the outer surfaces. A pair of upper and lower spaces is formed in a lower portion of the first spring body and an upper portion of the second spring body. Each of the upper and lower spaces is molded while a core is arranged therein during molding and the spaces are separated from an upper surface of the main body. The spaces are opened on the outer surface in a direction orthogonal to the outer surface such that each of the cores is extracted when a metallic mold used in the molding is opened.

However, in the push button switch, it is necessary to provide a spring for operation and a spring for return as illustrated in FIGS. 2 and 3 of Japanese Patent No. 3887057, which results in a problem in that the main body is large and can hardly achieve downsizing of the switch. Embodiments of the present invention have been devised in view of the problems described above, and an object of an embodiment thereof is to provide a compact silent-type switch.

SUMMARY

In accordance with an aspect of an embodiment of the present invention, there is provided a switch comprising: a cover; a base; and a push button comprising: an elastic touch piece formed in a sidewall of a sliding part of the push button, wherein the push button is vertically and slidably installed in a space formed by assembling the cover to the base, wherein a free end of the elastic touch piece is configured to abut the base when the push button is pushed, and the free end is configured to abut the cover when the pushed push button is returned.

In accordance with another aspect of an embodiment of the present invention, there is provided a keyboard in which the switch is assembled.

DETAILED DESCRIPTION

Figure 1A:
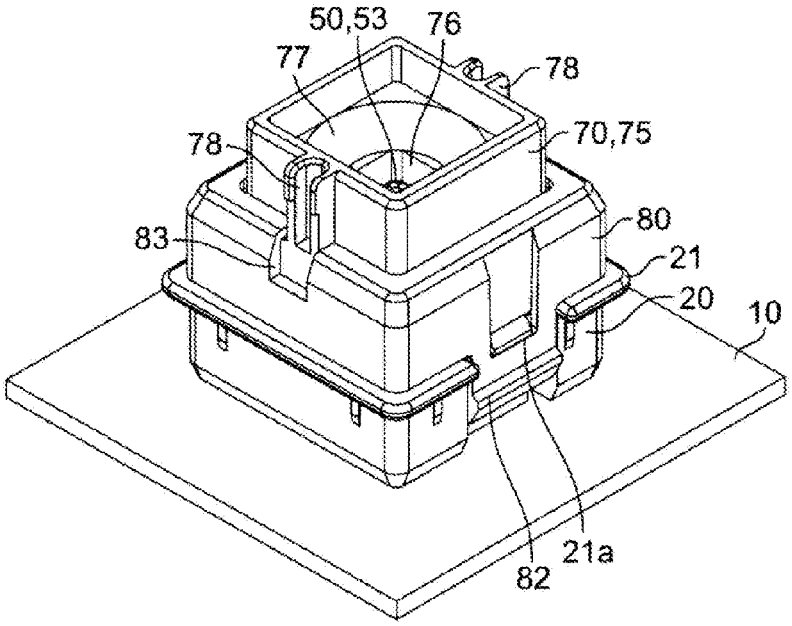
FIGS. 1A and 1B are overall perspective views illustrating a switch according to an embodiment of the present invention when the switch is viewed from different angles.
Figure 1B:
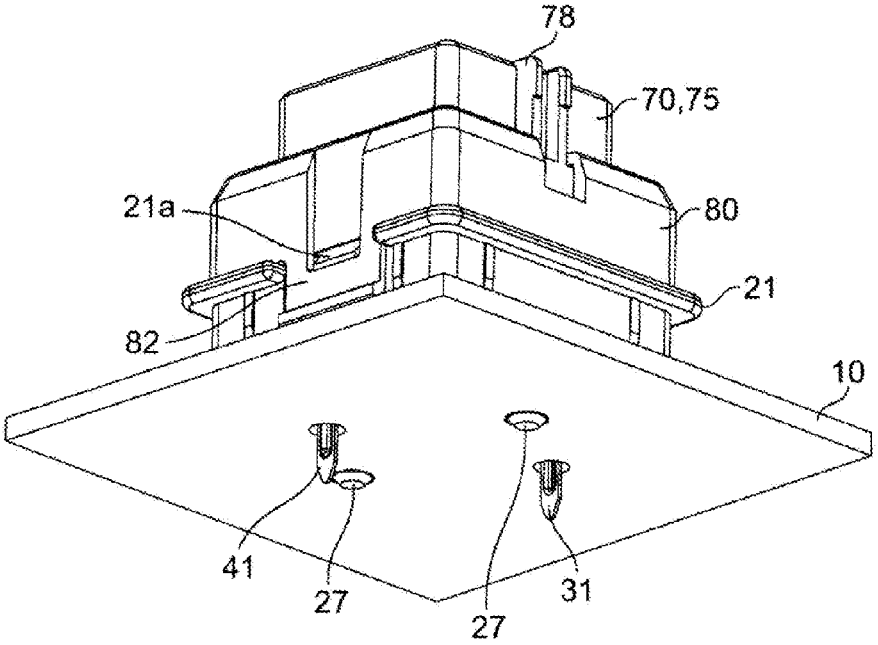

Hereinafter, a switch according to an embodiment will be described with reference to FIGS. 1A to 13B.

As illustrated in FIGS. 1A to 10B, a switch according to an embodiment includes a box-form base 20 installed in a board 10 on which a light source 11 such as an LED is surface-mounted, a pair of contact terminals 30 and 40 assembled in box-form base 20, a light guide 50, a return spring 60, a push button 70, and a frame-shaped cover 80.

Figure 2:
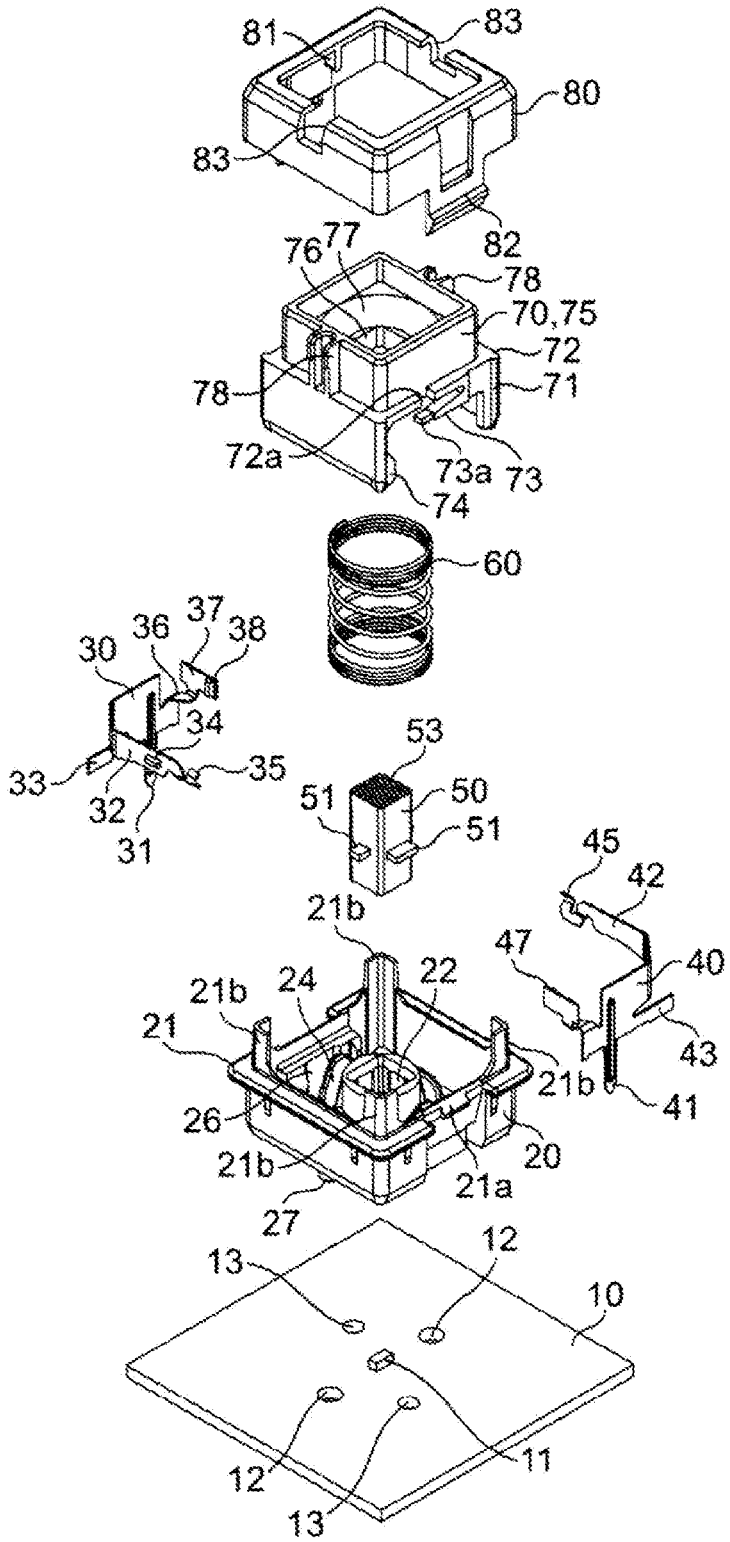
FIG. 2 is an exploded perspective view of the switch in FIG. 1A.

In the board 10, as illustrated in FIG. 2, a pair of aligning holes 12 is made while a surface-mounted light source 11 is located therebetween, and a pair of terminal holes 13 is made while the light source 11 is located therebetween.

Figure 4A:
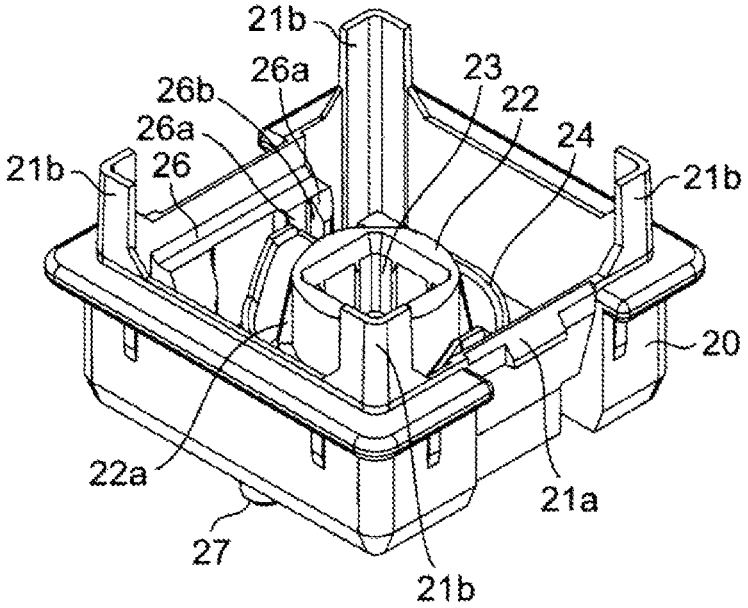
FIGS. 4A and 4B are enlarged perspective views illustrating a box-form base in FIGS. 2 and 3 when the box-form base is viewed from different angles.
Figure 4B:
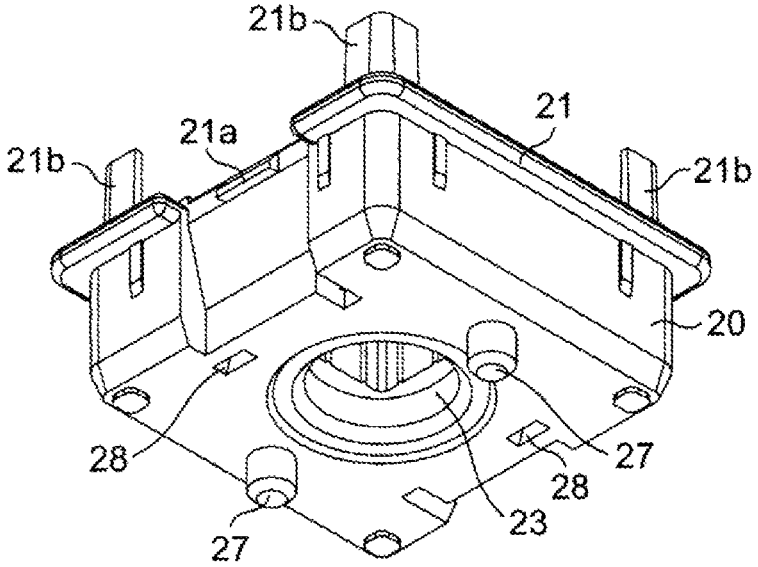
Figure 5:
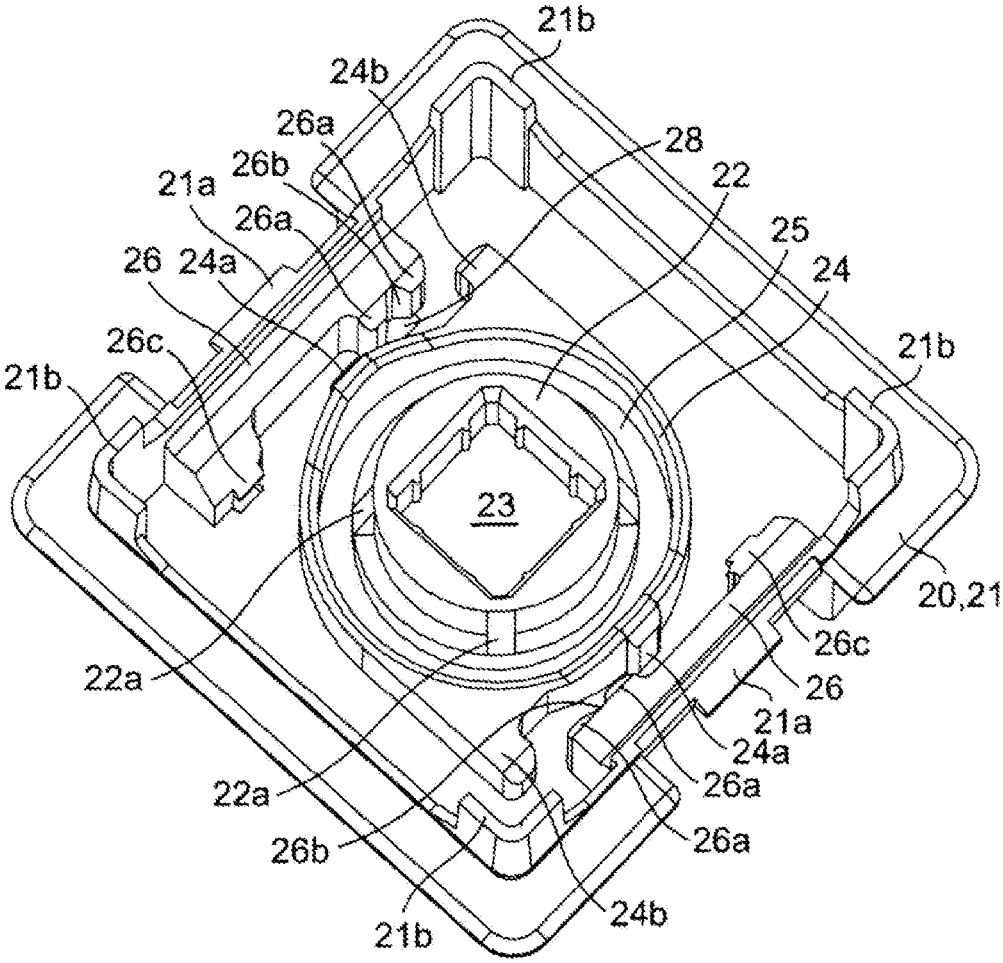
FIG. 5 is an enlarged perspective view illustrating the box-form base in FIGS. 4A and 4B when the box-form base is viewed from a different angle.

As illustrated in FIGS. 4A, 4B and 5, a box-form base 20 is a resin molded article having a square shape in planar view, an annular rib 21 is formed along an opening edge of the box-form base 20, and sides opposite to each other in an annular rib 21 are notched to form engage receiving parts 21*a*. Guide projections 21*b* each having a substantial L-shape in section are provided at corners of the opening edge of the box-form base 20. An insertion hole 23 having a square shape in planar view is made in the support base 22 projected from a center of a bottom surface of the box-form base 20, and reinforcing ribs 22*a* each including a tapered surface are molded while being integral with an outer peripheral surface of the support base 22.

In the box-form base 20, as illustrated in FIG. 5, a circular annular rib 24 is concentrically projected around the support base 22 to form an annular groove 25. A pair of press-fitting projections 24*a* and 24*b* is laterally projected from an outer peripheral surface of the circular annular rib 24 while press-fitting projections 24*a* and 24*b* are parallel to each other. In the box-form base 20, an abutting step 26 is projected from an inner surface opposite to press-fitting projections 24*a* and 24*b*, a pair of press-fitting projections 26*a* is provided in an edge portion on one of sides in the inner surface of the abutting step 26 to form a guide groove 26*b*, and a retaining projection 26*c* is provided in an edge portion on the other side. As illustrated in FIG. 4B, a pair of aligning projections 27 is provided in a lower surface of the box-form base 20 while an insertion hole 23 is made therebetween, and a pair of terminal holes 28 is also made. The terminal hole 28 communicates with the guide groove 26*b*.

Figure 6A:
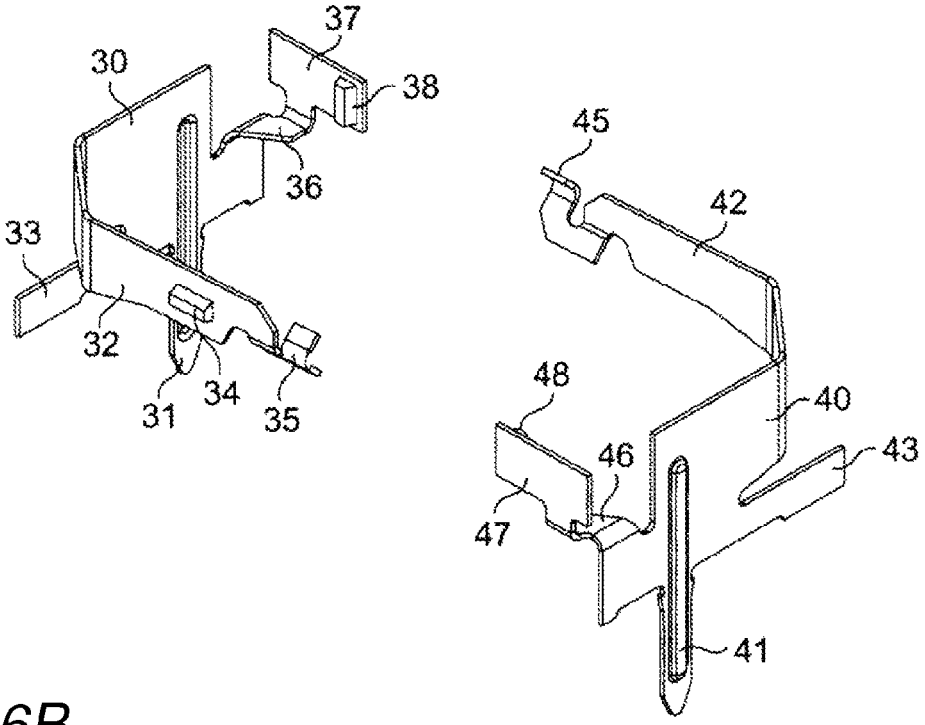
FIGS. 6A and 6B are enlarged perspective views illustrating a contact terminal in FIGS. 2 and 3 when the contact terminal is viewed from different angles.
Figure 6B:
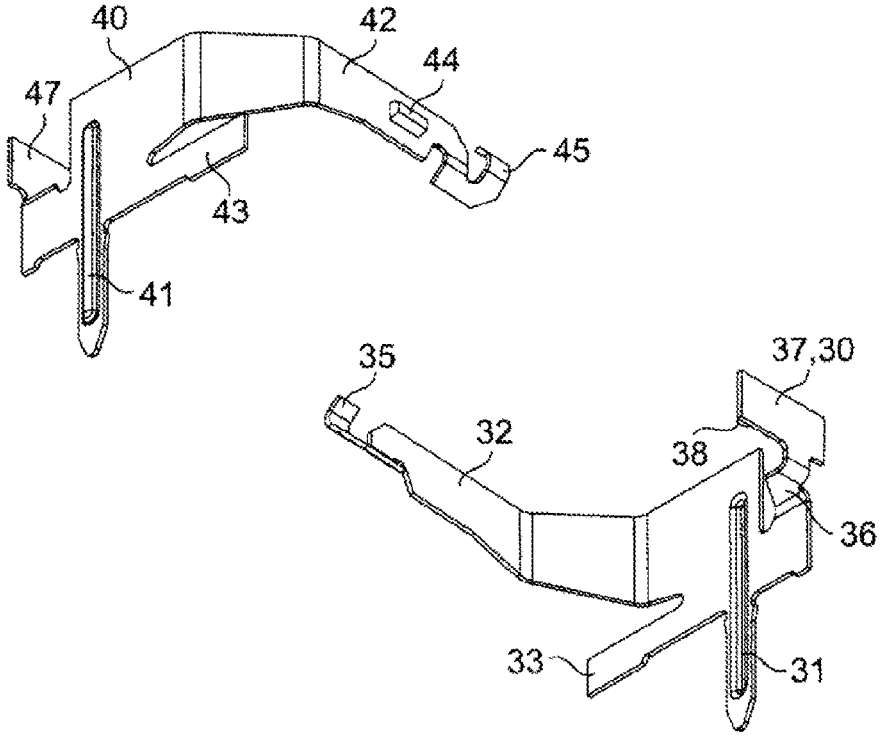

As illustrated in FIGS. 6A and 6B, the pair of contact terminals 30 and 40 are identical in shape, and is symmetrically arranged in the box-form base 20 with respect to a point.

A conductive sheet is punched and pressed to form the contact terminal 30, and the contact terminal 30 is processed to have a protrusion to form a terminal part 31. A resilient movable touch piece 32 and a retaining tongue piece 33 are extended from the edge portion on one of the sides of the terminal part 31. A movable contact 34 is provided in an outward surface in a free end of a movable touch piece 32, and a press receiving part 35 is laterally extended from the free end.

An aligning part 36 having a substantial L-shape is extended from the edge portion on the other side of the terminal part 31, and a fixed touch piece 37 is extended from an aligning part 36. A fixed contact 38 is provided in the edge portion of the inner surface of the fixed touch piece 37.

Since the contact terminal 40 has the same shape as the contact terminal 30, each part of the contact terminal 40 is designated by the numeral corresponding to the contact terminal 30, and the description will not be described.

When terminal parts 31 and 41 of contact terminals 30 and 40 are inserted in terminal holes 28 along guide grooves 26*b* of the box-form base 20, both sides of terminal parts 31 and 41 are press-fitted between press-fitting projections 26*a* and press-fitting projections 24*a* and 24*b* of the box-form base 20, thereby aligning contact terminals 30 and 40 in a plate thickness direction. When contact terminals 30 and 40 are further press-fitted, aligning parts 36 and 46 of contact terminals 30 and 40 abut on press-fitting projections 24*b* of the box-form base 20, thereby aligning contact terminals 30 and 40 in a vertical direction. Retaining tongue pieces 33 and 43 of contact terminals 30 and 40 are latched and retained in retaining projections 26*c* of the box-form base 20, respectively. Therefore, movable contacts 34 and 44 come into press contact with fixed contacts 48 and 38, respectively (see FIG. 10B).

As contact terminals 30 and 40 have the same shape, production cost can advantageously be reduced when using such similar components.

Figure 7A:
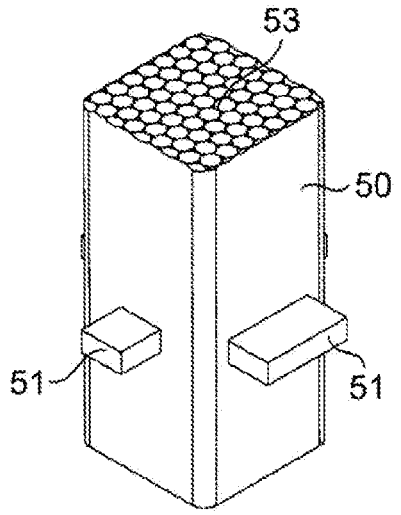
FIGS. 7A, 7B, and 7C show enlarged perspective views illustrating a light guide in FIGS. 2 and 3 when the light guide is viewed from different angles and a sectional view of the light guide.
Figure 7C:
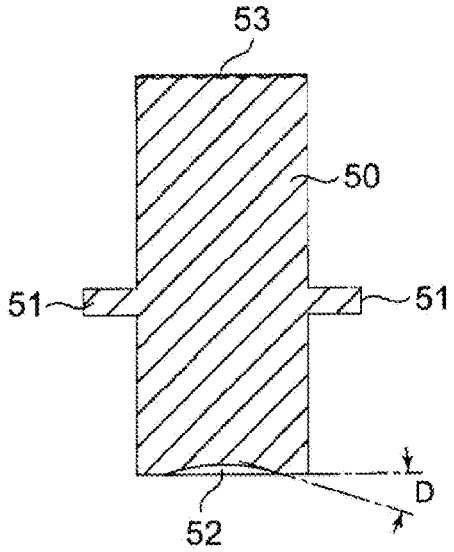
Figure 7B:
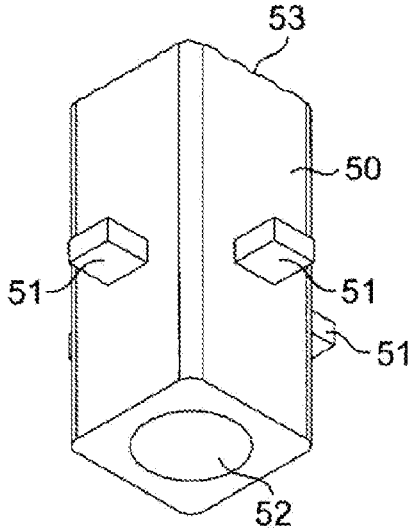

As illustrated in FIGS. 7A to 7C, the light guide 50 having a square prism shape is made of a translucent resin (such as a polycarbonate resin and an acrylic resin). An aligning projection 51 is provided on an outer surface of the light guide 50, a concave lens 52 is formed in an incident surface that is located in a lower end surface, and a microlens array or structure 53 is formed in an outgoing surface that is located in an upper end surface.

In the present embodiment, the luminance of the light emitted from the light source 11 is divided into two peaks by the concave lens 52 formed in the incident surface, which ensures a wide luminance distribution. Additionally, the directivity of the light emitted from the light source 11 is moderated by the microlens array 53 at the outgoing surface to ensure that a region brightened by the light source 11 has good luminance uniformity. The light guide 50 is not limited to the square prism shape, but the light guide 50 may have a columnar shape, a polygonal prism shape such as a triangular prism shape, a truncated cone shape, or a polygonal truncated pyramid shape.

Referring to FIG. 7C, the concave lens 52 at the incident surface is inclined at an inclination angle D relative to the incident surface. Preferably, the inclination angle D of the concave lens 52 is less than or equal to 55 degrees, or more preferably less than or equal to 50 degrees. This is because balance between the luminance uniformity and luminance efficiency is hard to achieve when the inclination angle exceeds 55 degrees.

Preferably, each of the microlenses in the microlens array 53 formed in the outgoing surface has a diameter of 1 mm or smaller. This is because the luminance uniformity is degraded when the diameter exceeds 1 mm.

Each of the microlenses in the microlens array 53 is inclined at a microlens inclination angle relative to the outgoing surface. Preferably, the microlens inclination angle ranges from 20 degrees to 60 degrees. When the microlens inclination angle is less than 20 degrees, the light is insufficiently mixed and the desired luminance uniformity cannot be ensured. When the microlens inclination angle exceeds 60 degrees, an angle formed between the microlenses adjacent to each other will be excessively decreased and will make it hard for production of a metallic mold to make the microlenses.

Preferably, the microlenses are uniformly arranged, more preferably, the microlenses are arranged adjacent to each other such that a flat gap surface between the microlens is not generated. With regard to a possible microlens arrangement method, for example, the microlenses may be arranged into a lattice shape, or the microlenses may be arranged into what is called a honeycomb structure in which six microlenses are located around one microlens. Furthermore, not only the microlenses are arranged so as to be adjacent to each other but the microlenses may also be arranged so as to partially overlap each other.

The light guide 50 is inserted into the insertion hole 23 of the support base 22 provided in the box-form base 20, and the aligning projection 51 of the light guide 50 is latched onto the upper end surface of the support base 22, thereby aligning the light guide 50.

Figure 3:
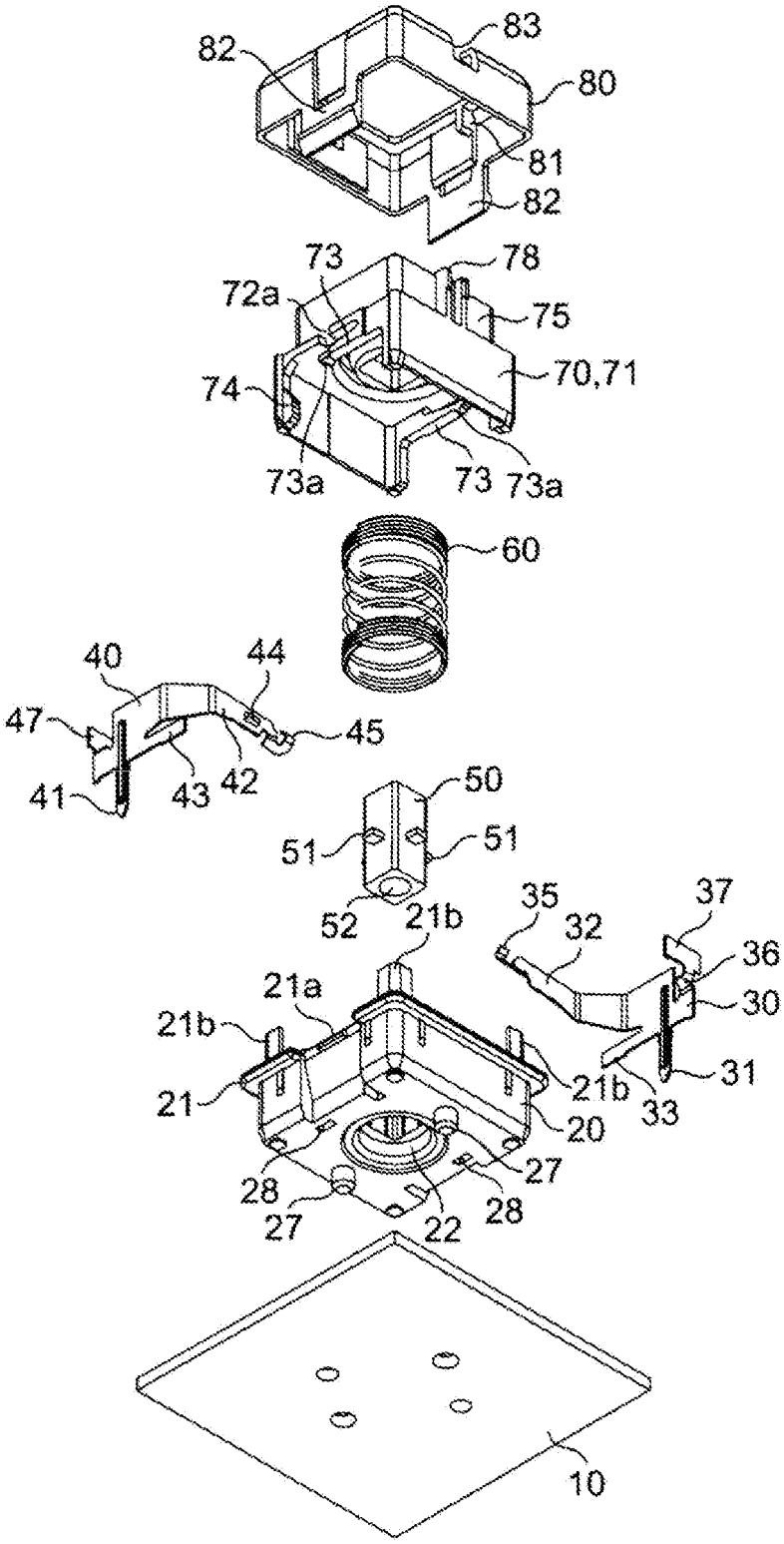
FIG. 3 is an exploded perspective view of the switch in FIG. 1B.

As illustrated in FIGS. 2 and 3, the return spring 60 is a coil spring, and return spring 60 is aligned in the annular groove 25 of the box-form base 20 to upwardly bias the push button 70.

Figure 8A:
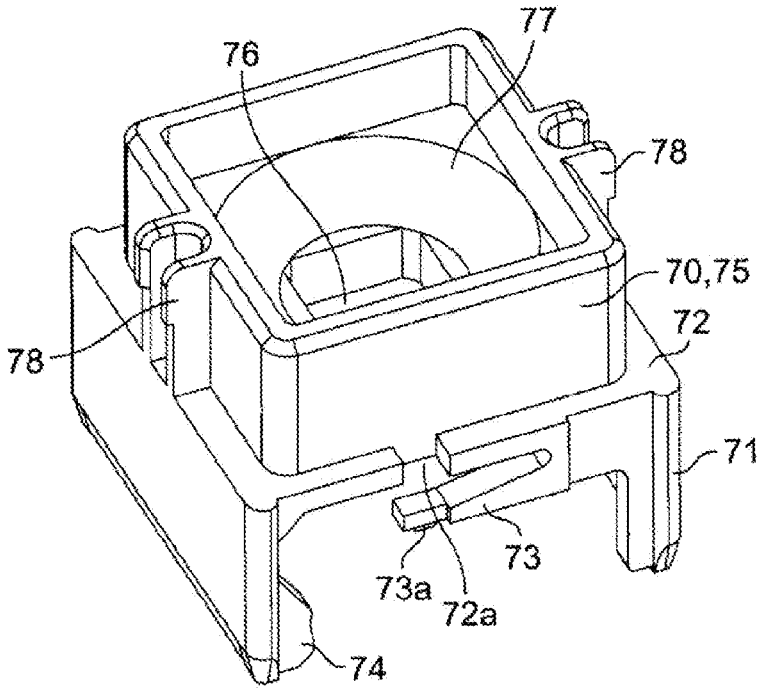
FIGS. 8A and 8B are enlarged perspective views illustrating a push button in FIGS. 2 and 3 when the push button is viewed from different angles.
Figure 8B:
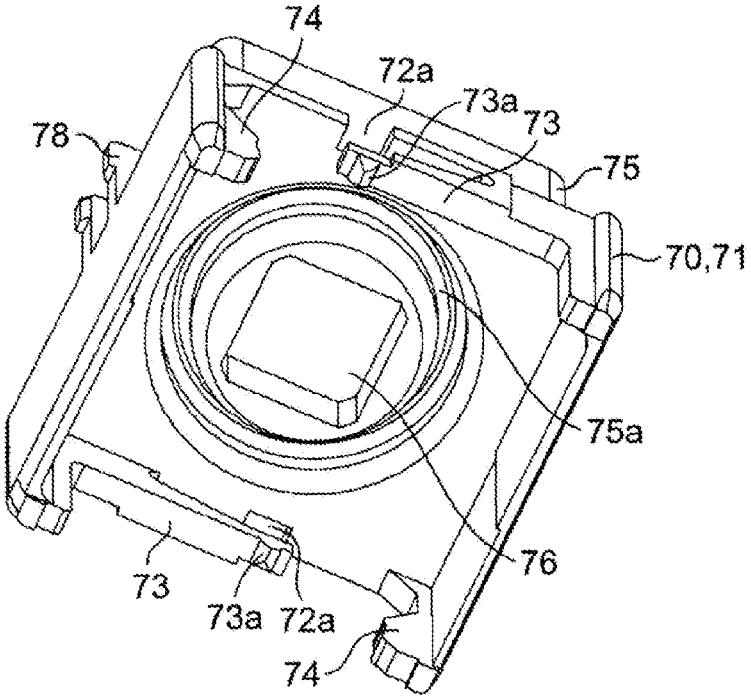

As illustrated in FIGS. 8A and 8B, a sliding part 71 and a frame-shape button body 75 are provided in the push button 70. The sliding part 71 has a planar shape slidably fitted through an opening of the box-form base 20. The button body 75 has a planar shape in which an annular step 72 can be formed in an upper surface of the sliding part 71.

The sliding part 71 has external dimensions adapted to be slidable along the opening of the box-form base 20, and a cantilever-shape elastic touch piece 73 and a pressing rib 74 are projected from an inner surface of the sliding part 71 in each of two edge portions of the push button 70 that are opposite to each other. In the sliding part 71, an abutting projection 73*a* is provided in the free end of the elastic touch piece 73, and a notch 72*a* is formed in the annular step 72 located above the elastic touch piece 73.

On the other hand, in the button body 75, a square fitting hole 76 is made in a center of a bottom surface, and a mortar-shaped tapered surface 77 is formed at an opening edge of the push button 70. In the button body 75, a pair of engaging ribs 78 is vertically arrayed in each of the outer surfaces opposite to each other in order to engage a cap (not illustrated) in which a character or the like is printed, and a circular annular groove 75*a* is provided in a center of a lower surface (see FIG. 8B) of the push button 70.

In the push button 70, a sliding part 71 is fitted in an opening of the box-form base 20, the light guide 50 is fitted in the square fitting hole 76 and an upper end of the return spring 60 is fitted in the circular annular groove 75*a*. In the push button 70, pressing ribs 74 can press on press receiving parts 35 and 45 of contact terminals 30 and 40 to elastically deform movable touch pieces 32 and 42 such that movable contacts 34 and 44 separate from fixed contacts 48 and 38.

As illustrated in FIGS. 2 and 3, a frame-shaped cover 80 has a planar shape in which the frame-shaped cover 80 can be placed on the annular rib 21 of the box-form base 20, and has a sectional shape in which the frame-shaped cover 80 can be latched and retained in the annular step 72 of the push button 70. Position restriction ribs 81 are projected from opening edges opposite to each other in the inner surface of the frame-shaped cover 80. In the frame-shaped cover 80, elastic engaging parts 82 are projected from each of a pair of outer surfaces opposite to each other, and fitting notches 83 are provided in each of the other pair of outer surfaces opposite to each other.

An engaging rib 78 of the push button 70 is slidably fitted into the fitting notch 83 by fitting the frame-shaped cover 80 onto the box-form base 20, and the push button 70 is retained by elastically engaging the elastic engaging part 82 in the engage receiving part 21*a* of the box-form base 20.

Operation of the switch including the above components will be described below.

In an embodiment, the contact terminal 30 is mainly described because contact terminals 30 and 40 are symmetrically arranged with respect to a point and are similar.

Figure 9A:
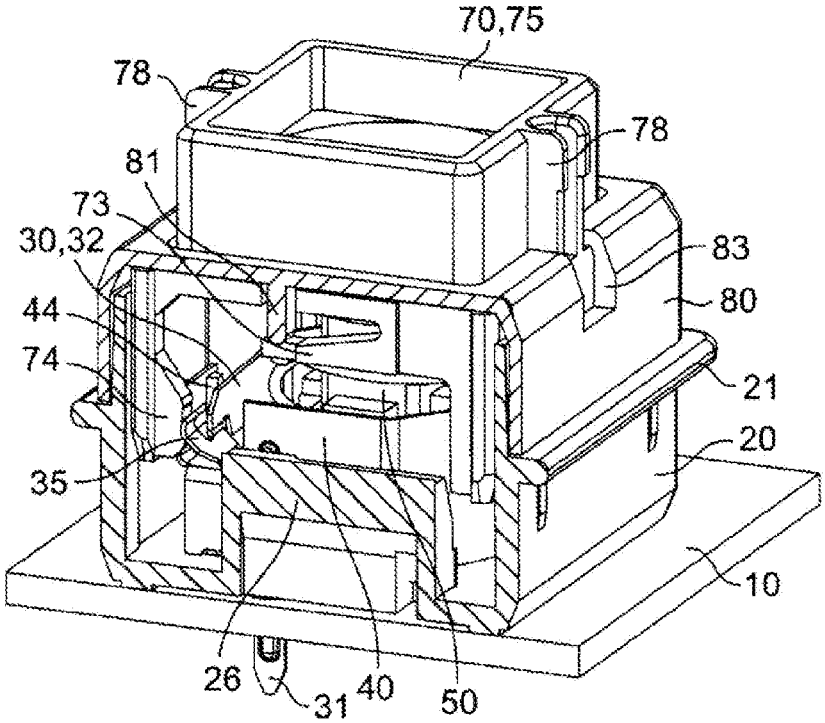
FIGS. 9A and 9B are a longitudinal sectional perspective view and a transverse sectional view illustrating the switch in FIGS. 1A and 1B before operation.
Figure 9B:
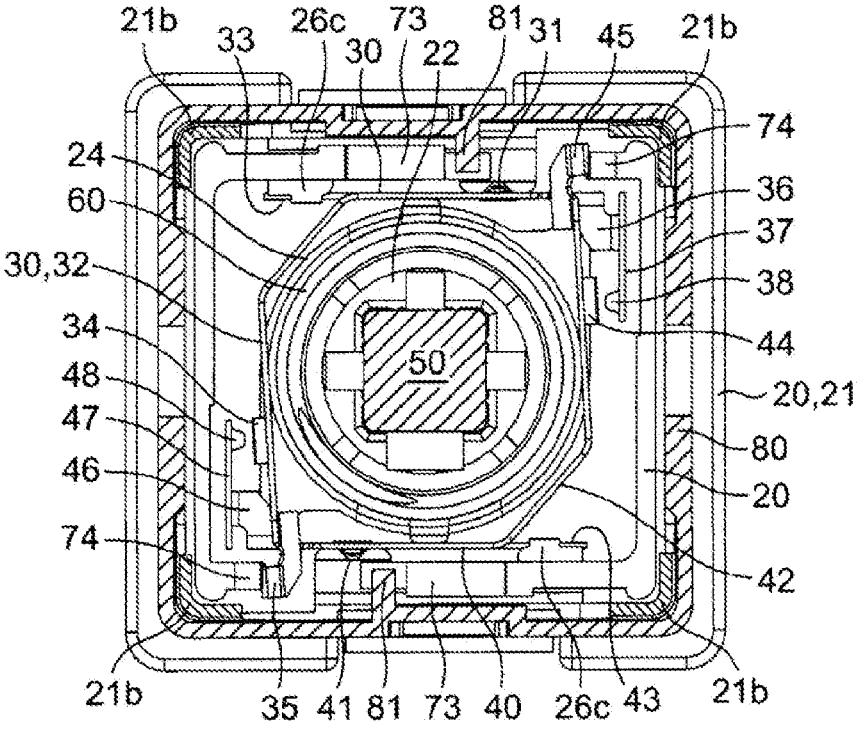

As illustrated in FIGS. 9A and 9B, in the case that the push button 70 is not pressed, the elastic touch piece 73 of the push button 70 abuts the position restriction rib 81 of the frame-shaped cover 80. On the other hand, because the pressing rib 74 of the push button 70 presses press receiving part 35 of the contact terminal 30, the movable touch piece 32 is elastically deformed, and the movable contact 34 separates from the fixed contact 48 of contact terminal 40.

Figure 10A:
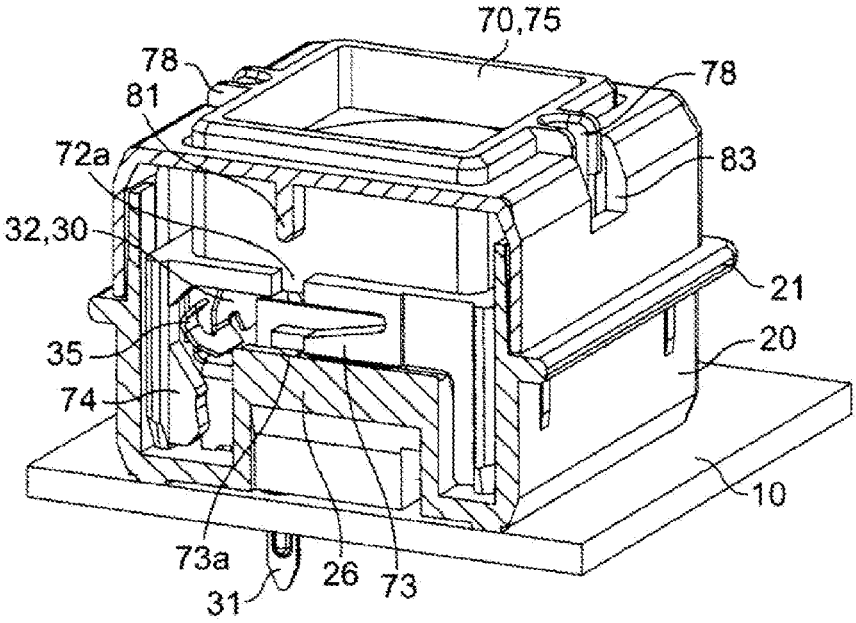
FIGS. 10A and 10B are a longitudinal sectional perspective view and a transverse sectional view illustrating the switch in FIGS. 1A and 1B after operation.
Figure 10B:
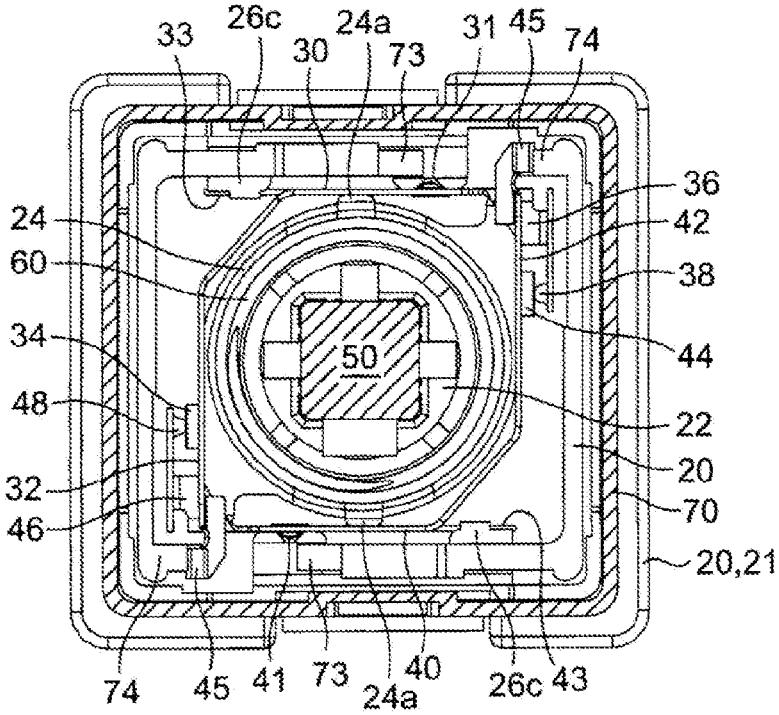
Figure 11A:
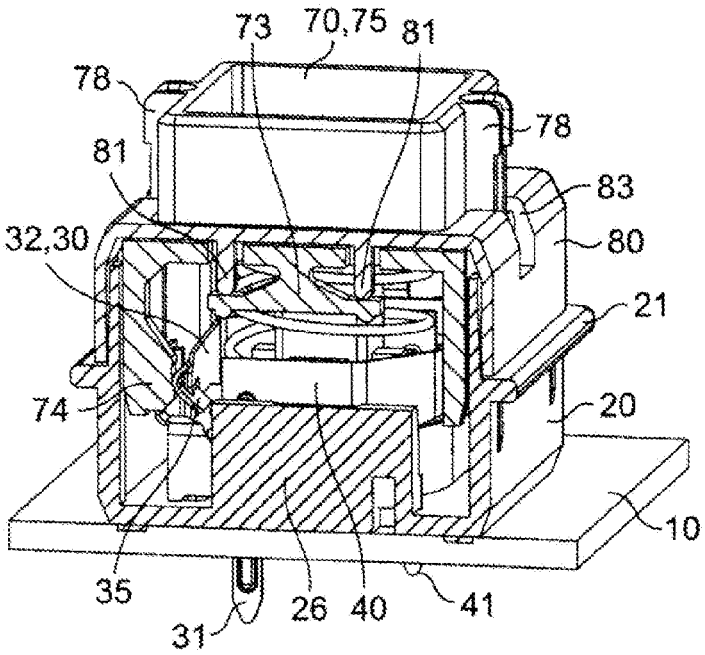
FIGS. 11A and 11B are longitudinal sectional perspective views illustrating a switch according to a second embodiment before and after operation.
Figure 11B:
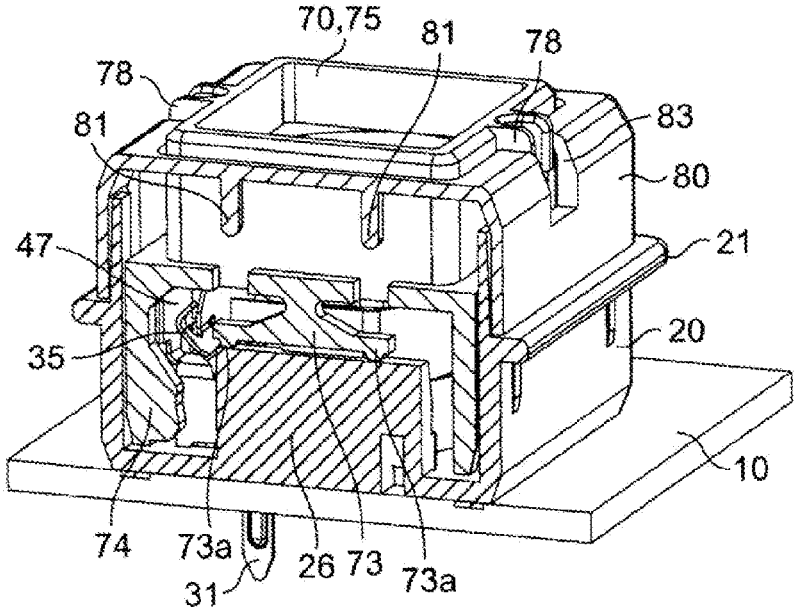

As illustrated in FIGS. 10A and 10B, when the push button 70 is pushed down against a spring force of the return spring 60, the pressing rib 74 disengages from press receiving part 35 of the movable touch piece 32. At the same time, movable touch piece 32 returns elastically, the movable contact 34 comes into contact with the fixed contact 48 of the contact terminal 40, and the pair of contact terminals 30 and 40 is electrically connected to each other to output an operation signal. As a result, the light source 11 is lit through a control circuit (not illustrated), light is output from concave lens 52 in the incident surface of the light guide 50 through the micro-lens array 53 in the outgoing surface, and passes through a lighting surface of a keytop (not illustrated). At this point, the abutting projection 73*a* of the elastic touch piece 73 of the push button 70 abuts the upper end surface of the abutting step 26 of the box-form base 20. However, because of the elastic deformation of the elastic touch piece 73 and a small contact area of abutting projection 73*a*, a large impact noise is not generated and a silent type switch is obtained.

When the pressing of the push button 70 is released, the push button 70 is pushed up by the spring force of the return spring 60, the pressing rib 74 presses pressing receiving part 35 of the movable touch piece 32 again, and the movable contact 34 separates from the fixed contact 48. When the push button 70 returns to an original position, the elastic touch piece 73 is elastically deformed to restrain the generation of an impact noise even when the elastic touch piece 73 of the push button 70 abuts the position restriction rib 81 of the frame-shaped cover 80. Particularly, when the elastic touch piece 73 abuts the position restriction rib 81, the position restriction rib 81 is fitted in the notch 72*a* of the push button 70 to separate an inner space and an outer space of the push button 70 from each other. Therefore, according to an embodiment, the silent type switch having small operation sound and push button return sound is obtained.

In the case that the light source 11 is turned off, similar to the above operation, the push button 70 will be pressed to output an operation signal and the light source 11 is turned off through control of the control circuit (not illustrated).

In an embodiment, the light source 11 is lit and turned off by operating push button 70. Alternatively, for example, the light source 11 may always be lit or blinked through a control circuit (not illustrated) irrespective of the operation of the push button 70.

FIGS. 11A to 13B illustrate an embodiment having a basic configuration which is substantially similar to the embodiment illustrated in FIGS. 1A to 10B, and differs in shapes of the push button 70 and the frame-shaped cover 80.

Figure 12A:
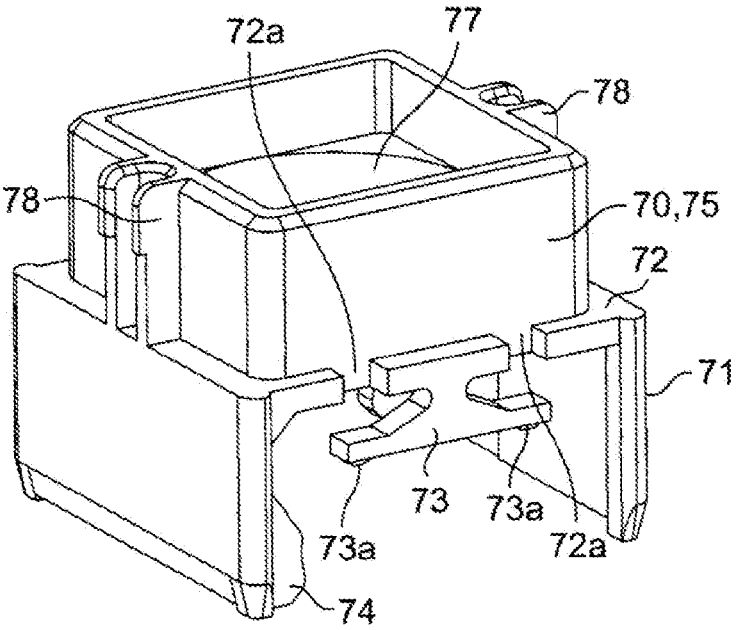
FIGS. 12A and 12B are enlarged perspective views illustrating a push button of the switch in FIGS. 11A and 11B when the push button is viewed from different angles.
Figure 12B:
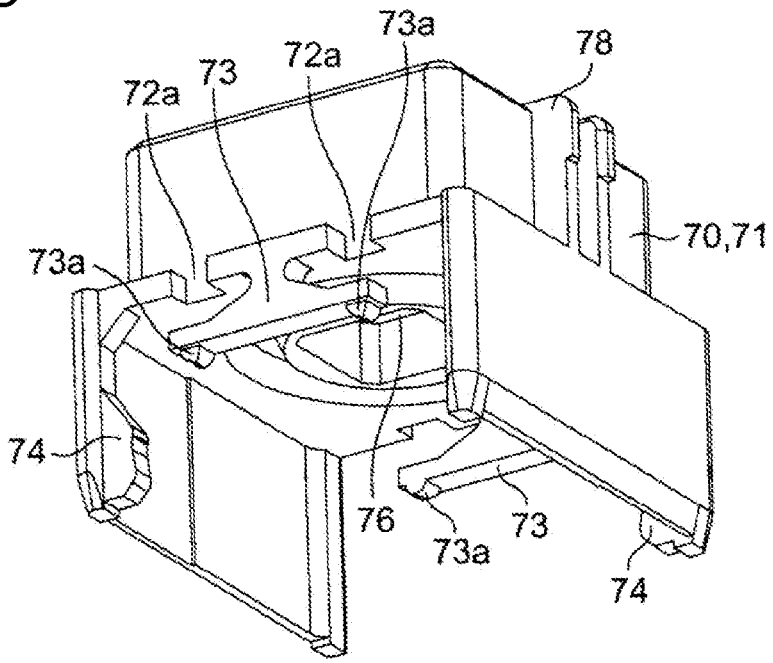
Figure 13A:
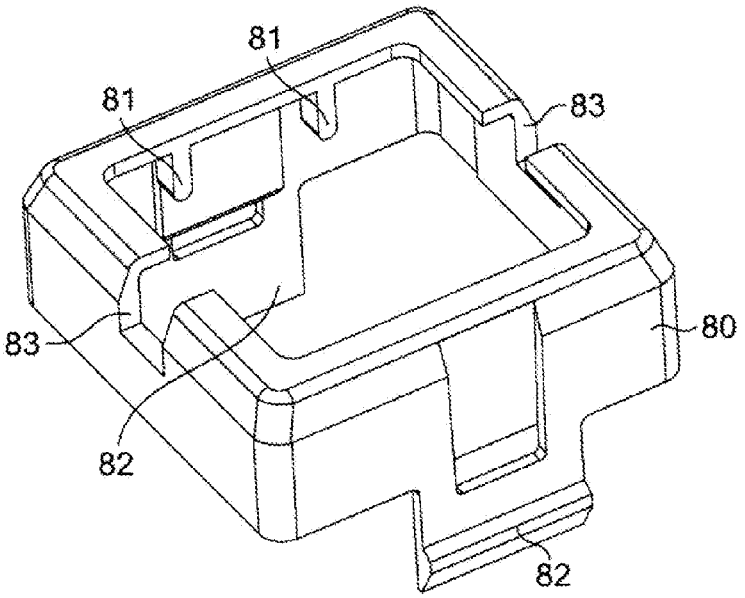
FIGS. 13A and 13B are enlarged perspective views illustrating a frame-shaped cover of the switch in FIGS. 11A and 11B when the frame-shaped cover is viewed from different angles.
Figure 13B:
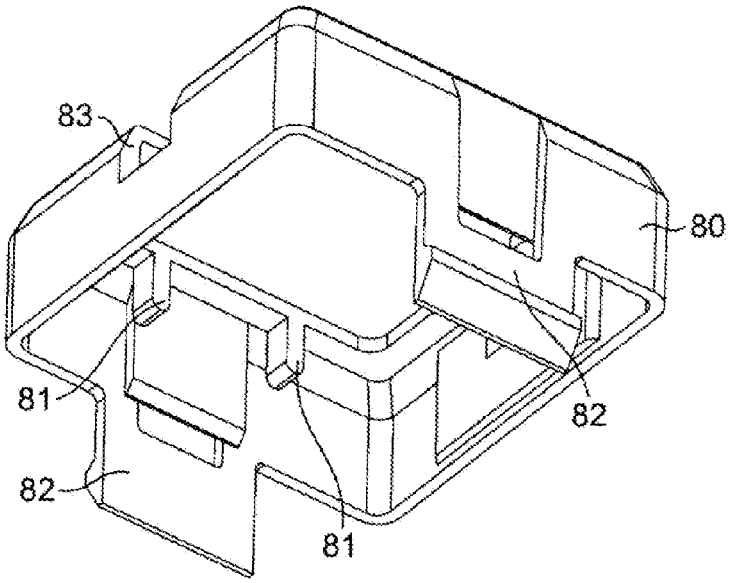

As illustrated in FIGS. 12A and 12B, the push button 70 is substantially similar to the push button 70 in FIGS. 8A and 8B, and differs in that the elastic touch piece 73 is formed into a substantial T-shape. As illustrated in FIGS. 13A and 13B, the frame-shaped cover 80 is substantially similar to the frame-shaped cover 80 of FIG. 2 and differs in that a pair of position restriction ribs 81 is provided. Since other configurations in the embodiments described are similar, the same components will be designated by the same numeral, and will not be described.

In the push button 70, the operations performed by the pressing, the release and the return operation are substantially similar to those of the embodiment illustrated in FIGS. 1A to 10B. The operation of push button 70 differs from the embodiment illustrated in FIGS. 1A to 10B in that, during the operation and the return of the push button 70, both ends of the elastic touch piece 73 abut the upper end surface of the abutting step 26 of the box-form base 20 and the pair of position restriction ribs 81 of the frame-shaped cover 80, respectively. Therefore, impact energy is dispersed to four points, and the impact noise is decreased compared with the embodiment in for example, FIG. 1A and FIG. 1B. Advantageously, a more silent type switch can be obtained.

The switch of an embodiment of the present invention can be applied to not only the keyboard switch but also to other switches.

In accordance with one aspect of an embodiment of the present invention, there is provided a switch comprising: a cover; a base; and a push button comprising: an elastic touch piece formed in a sidewall of a sliding part of the push button, wherein the push button is vertically and slidably installed in a space formed by assembling the cover to the base, wherein a free end of the elastic touch piece is configured to abut the base when the push button is pushed, and the free end is configured to abut the cover when the pushed push button is returned.

Accordingly, one elastic touch piece abuts the base and the cover to absorb and reduce an impact noise during the operation and the return, so that a compact silent-type switch can be obtained.

In the switch, the push button may vertically and slidably be installed in a space formed by assembling a frame-shaped cover in a box-form base.

Accordingly, a compact and more silent switch is obtained by sliding the push button in a closed space.

In the switch, an abutting step may be provided in an inner surface of the base, the abutting step configured such that the elastic touch piece of the push button abuts the abutting step when the push button is pushed. Additionally, a position restriction rib may be projected in an inner surface of the cover, the position restriction rib configured such that the elastic touch piece of the push button abuts the position restriction rib when the push button is returned.

Accordingly, an operating stroke is shortened to obtain a more compact switch.

In the switch, the elastic touch piece may have a cantilever shape, or the elastic touch piece may have a T-shape in front view.

Accordingly, a degree of freedom in design is enhanced. Particularly, a more silent switch is obtained when the elastic touch piece has the T-shape in front view.

In the switch, an abutting projection configured to abut the base may be provided at the free end of the elastic touch piece.

Because the abutting projection having a small abutting area abuts the base, a more silent switch is obtained.

In the switch, a notch may be provided in the push button, the notch configured such that the position restriction rib of the cover fits in the notch when the push button is returned.

Because an inner space and an outer space of the push button are separated from each other by fitting the position restriction rib in the notch provided in the push button, impact noise does not leak and a more silent switch is obtained.

In accordance with another aspect of another embodiment of the present invention, a keyboard includes the switch.

Accordingly, one elastic touch piece abuts the base and the cover to absorb and reduce impact noise during operation and return of the push button, so that a compact silent-type keyboard can advantageously be obtained.

What is claimed is:

1. A switch comprising:

a cover;

a base; and a push button comprising:

an elastic touch piece formed in a sidewall of a sliding part of the push button, the push button being vertically and slidably installed in a space formed by assembling the cover to the base, the elastic touch piece having a free end configured to abut the base when the push button is pushed and abut the cover when the pushed push button is returned;

wherein an abutting step is projected into the space from an inward facing surface of the base, the abutting step being configured such that the elastic touch piece of the push button abuts the abutting step when the push button is pushed.

2. The switch according to claim 1, wherein the push button is vertically and slidably installed in a space formed by assembling a frame-shaped cover to a box-form base.

3. The switch according to claim 1, wherein a position restriction rib is projected in an inner surface of the cover, the position restriction rib being configured such that the elastic touch piece of the push button abuts the position restriction rib when the push button is returned.

4. The switch according to claim 3, wherein a notch is provided in the push button, the notch being configured such that the position restriction rib of the cover fits in the notch when the push button is returned.

5. The switch according to claim 1, wherein the elastic touch piece has a cantilever shape.

6. The switch according to claim 1, wherein the elastic touch piece has a T-shape in front view.

7. The switch according to claim 1, wherein an abutting projection configured to abut the base is provided at the free end of the elastic touch piece.

8. A keyboard in which the switch according to claim 1 is assembled.

* * * * *